United States Patent [19]

Suzuki et al.

[11] Patent Number: 4,695,260

[45] Date of Patent: Sep. 22, 1987

[54] TILTING DEVICE FOR MARINE PROPULSION DEVICE

[75] Inventors: Hideo Suzuki, Shizuoka; Kazunobu Nozue, Kosai, both of Japan

[73] Assignee: Sanshin Kogyo Kabushiki Kaisha, Japan

[21] Appl. No.: 669,317

[22] Filed: Nov. 7, 1984

[30] Foreign Application Priority Data

Nov. 15, 1983 [JP] Japan ..... 58-213196

[51] Int. Cl.[4] ..... B63H 5/12

[52] U.S. Cl. ..... 440/61

[58] Field of Search ..... 440/53, 61, 80, 62, 440/63, 79, 1, 2

[56] References Cited

U.S. PATENT DOCUMENTS 3,839,986 10/1974 Meyer et al. ..... 440/61

4,310,320 1/1982 Pitchford ..... 440/61

OTHER PUBLICATIONS

Brochue and translation.

*Primary Examiner*—Jeffrey V. Nase

*Assistant Examiner*—Jesus D. Sotelo

*Attorney, Agent, or Firm*—Ernest A. Beutler

[57] ABSTRACT

An improved tilting device for a marine propulsion apparatus embodying a control circuit for continuously energizing the power means upon operator activation for driving the outboard drive to the extreme limit of its travel without necessitating continuous holding by the operator.

9 Claims, 3 Drawing Figures

TILTING DEVICE FOR MARINE PROPULSION DEVICE

BACKGROUND OF THE INVENTION

This invention relates to a tilting device for marine propulsion apparatus and more particularly to an improved control system for such apparatus.

It is well known to provide power tilt and trim units for marine outboard drives be they the outboard drive unit of an inboard/outboard or that of an outboard motor per se. Such devices have particular utility, particularly with larger horse power units which are very heavy for the operator to manipulate. Such devices normally include a reversible electric motor driven hydraulic pump that operates tilt and trim cylinder assemblies for moving the outboard drive through a range of trim adjusted positions as well as between a tilted up and tilted down condition. Although such devices have particular utility, the controls for these devices have necessitated the operator holding the control in position until the outboard drive reaches the desired position. Thus, the operator's hand must be continuously on the control and, at times, this is undesirable.

It is, therefore, a principal object of this invention to provide an improved tilting device for marine propulsion apparatus.

It is a further object of this invention to provide a tilting device for an outboard drive that has a holding device so that the operator need not hold the control during the full movement of the drive.

It is a further object of this invention to provide an improved control for the tilting device of a marine propulsion apparatus.

SUMMARY OF THE INVENTION

This invention relates to a tilt mechanism for a marine outboard drive supported for tilting movement about a generally horizontally extending tilt axis relative to the transom or the like of a watercraft. Power means are provided for effecting tilting movement of the outboard drive about the tilt axis. Control means are also provided for selectively activating the power means for energizing the power means continuously upon the activation of the control means without necessitating an operator to maintain the control means in its activated position.

DETAILED DESCRIPTION OF THE PREFERRED EMBODIMENT

Figure 1:
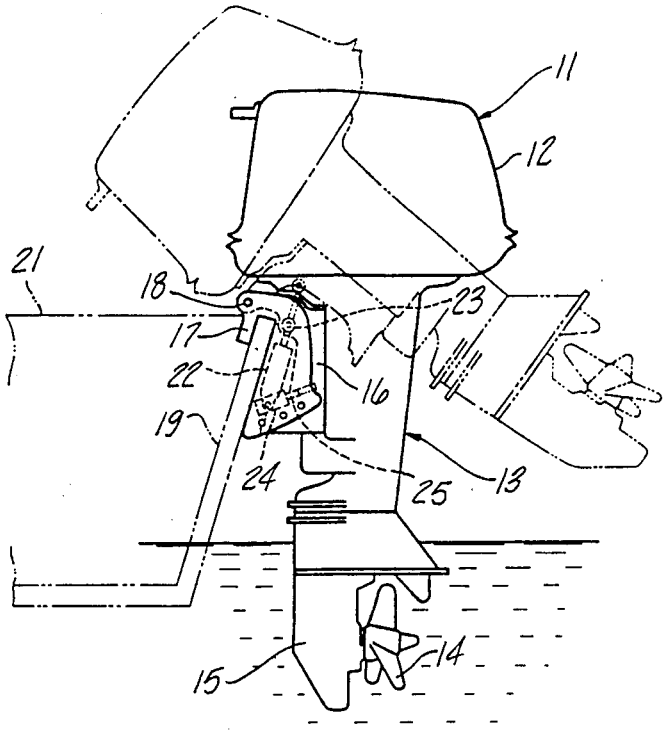
FIG. 1 is a side elevational view of an outboard motor constructed in accordance with an embodiment of this invention, as attached to the transom of an associated watercraft, which watercraft is shown partially and in phantom. The solid line view shows the motor in its normal running condition while the phantom line view shows it in a tilted up condition.

Referring now in detail to the drawings and initially, primarily to FIG. 1, an outboard drive constructed in accordance with the invention is identified generally by the reference numeral 11 and is embodied in an outboard motor. It is to be understood that although the invention is described in conjunction with an outboard motor, it is equally applicable to other outboard drives such as the outboard drive unit of an inboard/outboard drive.

The outboard motor 11 includes a power head 12 that is comprised of an internal combustion engine and a protective cowling. A drive shaft housing, indicated generally by the reference numeral 13, depends from the power head 12 and contains a drive shaft that drives a propeller 14 carried by a lower unit 15 via a forward, neutral, reverse transmission of a suitable type (not shown).

The drive shaft housing 13 is connected to a swivel bracket 16 by means including a steering shaft (not shown) for steering of the outboard motor 11 about a generally vertically extending steering axis. The swivel bracket 16 is, in turn, connected to a clamping bracket 17 by means including a pivot pin 18 for tilting movement about a horizontally extending tilt axis. The clamping bracket 17 includes clamping means (not shown) for affording a detachable connection to a transom 19 of an associated watercraft 21.

A tilt cylinder assembly, indicated generally by the reference numeral 22, has a piston rod 23 that is pivotally connected at one of its ends to the swivel bracket 16. The cylinder 22 is, in turn, pivotally connected to the clamping bracket 17 so that extension of the piston rod 23 relative to the cylinder 22 will effect tilting movement of the outboard motor 11 about the pivot pin 18.

In addition, one or more trim cylinders 24 are provided with piston rods 25. The trim cylinders 24 are fixedly carried by the clamping bracket 17 and the piston rods 25 engage the swivel bracket 16 so as to effect limited pivotal movement of the outboard motor 11 relative to the tilt pin 18 for trim adjustment.

Figure 2:
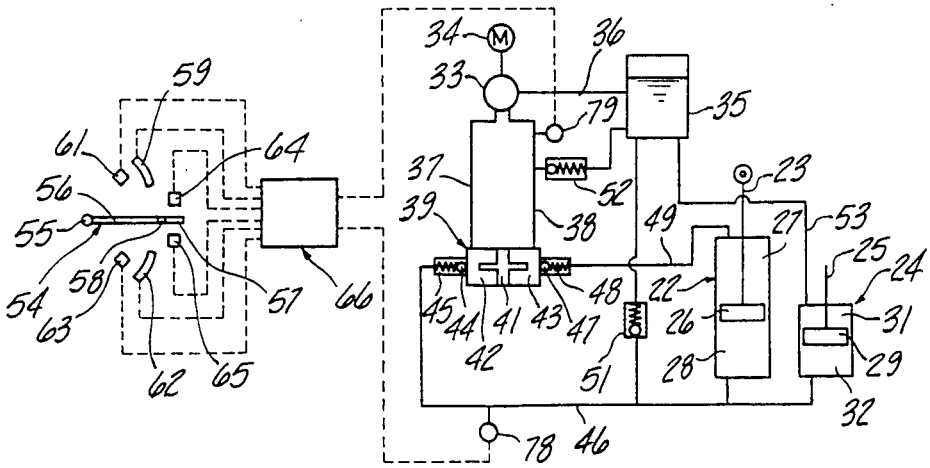
FIG. 2 is a schematic view showing the hydraulic tilt and trim apparatus as well as the control circuitry therefor.

Referring now additionally and primarily to FIG. 2, the hydraulic circuit for actuating the trim cylinder 24 and tilt cylinder 22 will be described. The tilt cylinder 22 has a piston 26 that is affixed to the end of the piston rod 23 that extends into the cylinder. The piston 26 divides the tilt cylinder into an upper chamber 27 and a lower chamber 28.

In a similar manner, the trim cylinder 24 includes a piston 29 that is affixed to its piston rod 25 and which divides the trim cylinder 24 into an upper chamber 31 and a lower chamber 32.

Fluid under pressure for activating the trim cylinder 24 tilt cylinder 22 is derived from a reversible hydraulic pump 33 that is driven by a reversible electric motor 34. A reservoir 35 is connected to the pump 33 by a makeup line 36. The pump 33 has a pair of outlet lines 37 and 38, one of which is pressurized during rotation of the pump 33 and the other of which forms the return line. The line 37 is the tilt and trim up pressure line while the line 38 is the tilt and trim down pressure line, as will become apparent.

The lines 37 and 38 extend to a shuttle valve assembly, indicated generally by the reference numeral 39. The shuttle valve assembly 39 has an internal chamber in which a shuttle piston 41 is supported for sliding movement so as to divide the chamber into first and second portions 42 and 43. A check valve 44 is normally urged to a closed position by means of a spring 45 and controls the flow between a chamber 42 and a tilt up pressure line 46. The line 46, in turn, extends to and communicates with the lower chamber 28 of the tilt cylinder assembly 22 and the lower chamber 32 of the trim cylinder 24.

A ball check valve 47 is normally urged to a closed position by means of a coil compression spring 48 and permits communication between the shuttle valve chamber 43 and a power tilt down line 49. The line 49 extends to the upper chamber 27 of the tilt cylinder assembly 22.

A tilt up relief valve 51 extends from the line 46 back to the reservoir 35. A tilt down relief valve 52 controls the flow from the line 38 back to the reservoir 35. In addition, a trim up return line 53 extends from the upper chamber 31 of the trim cylinder assembly 24 back to the reservoir 35.

When the motor 34 is energized to run the pump 33 in the tilt or trim up mode, the line 37 will be pressurized and the line 38 will act as a return line. The generation of pressure in the line 37 causes the shuttle piston 41 to be urged to the right and a projection of the piston 41 will engage the check valve 47 so as to force the check valve 47 opened against the action of the spring 48. The line 49 then communicates with the line 38 through the chamber 43.

At the same time, pressurization of the line 37 and chamber 42 is sufficient to cause the check valve 44 to become unseated and pressurize the line 46 so that fluid under pressure is delivered to the tilt cylinder chamber 28 and the trim cylinder chamber 32. The pistons 26 and 29 are then driven upwardly. As has been previously noted, fluid from the chamber 27 of the tilt cylinder 22 can be returned back to the pump 33 through the opened check valve 47, chamber 43 and line 38. At the same time, fluid will be displaced from the trim cylinder chamber 31 through the line 53 back to the reservoir 35. If the motor 34 is continued to be energized until the motor 11 has been tilted up all the way, there will be an abrupt rise in pressure in the line 46 and the tilt up relief valve 51 will open so as to recirculate the hydraulic fluid back to the reservoir 35 and prevent damage.

To effect tilting down operation, the motor 34 is driven in the opposite direction so that the pump 33 will pressurize the line 38 and the line 37 acts as a relief line. Under this condition, the shuttle valve chamber 43 is pressurized and the shuttle piston 44 will move to the left so its projection is operative to unseat the check valve 44 against the action of the spring 45 and expose the line 46 to the return line 37 through the chamber 42.

Pressurization of the chamber 43 is sufficient to cause the check valve 47 to open against the action of the spring 48 and pressurize the line 49 and the tilt cylinder chamber 27. This pressure causes the tilt cylinder piston 26 and its piston rod to move downwardly and effect downward movement of the motor 11. It should be noted that the chamber 31 of the trim cylinder 24 is not pressurized at this time since its assistance in trim down operation is not required particularly in light of the weight of the outboard motor 11 that will assist in the tilting down operation. However, fluid may fill the chamber 31 from the reservoir 35 through the line 53.

When the pistons 26 and 29 are moved downwardly, fluid will be displaced from the chambers 28 and 32 and return back to the inlet side of the pump 33 through the line 46, shuttle valve chamber 42 and line 37.

The direction of rotation and operation of the motor 34 is controlled by a switch assembly, indicated generally by the reference numeral 54. The switch assembly 54 includes a manually operated actuator 55 that is positioned within the hull of the watercraft 21 so as to be actuated by its operator. The member 55 has a first electrically conductive portion 56 and a second electrically conductive portion 57 which are separated by an insulating portion 58. The portion 56 is adapted to cooperate with a trim up contact 59 and a tilt hold up contact 61 which are both positioned on one side of the member 55. In a similar manner, the portion 56 is adapted to cooperate with a trim down contact portion 62 and a hold tilt down contact portion 63 which are positioned on the other side of the member 55.

The conductive portion 57 is also adapted to cooperate with a tilt down release contact 64 positioned on the same side as the contacts 59 and 61 and a tilt up release contact 65 positioned on the same side as the contacts 62 and 63. The contacts 59, 61, 62, 63, 64 and 65 are all in circuit with a control circuit, indicated generally by the reference numeral 66 and which has a configuration as shown in more detail in FIG. 3. The circuit is such that if the manual operator 55 is moved from the null or neutral position as shown in the solid views of FIGS. 2 and 3 so as to contact either the trim up contact 59 or trim down contact 62, the motor 34 will be energized in the appropriate direction only so long as this connection is maintained. However, if the manual operator 55 is moved so as to contact either the tilt up hold terminal 61 or tilt down hold terminal 63, the motor 34 will be energized continuously in the appropriate direction until it is released automatically or by the operator moving the conducting portion 57 of the member 55 into engagement with the appropriate release switch contact 64 or 65.

Figure 3:
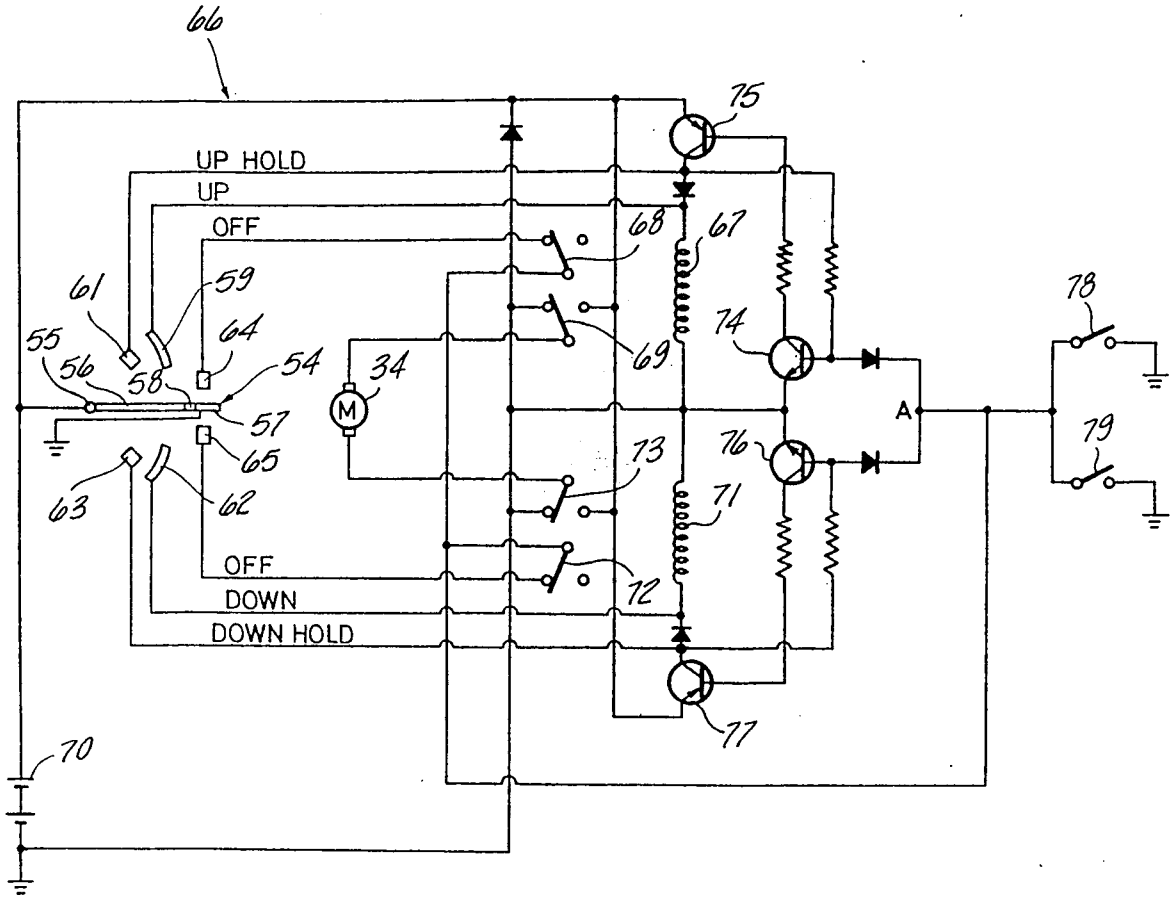
FIG. 3 is an electrical diagram showing the details of the control circuit.

Referring now primarily to FIG. 3, the trim up contact 59 is in circuit with a relay switch having a solenoid coil 67 that actuates a normally closed contact 68 and a normally opened contact 69. In a similar manner, the trim down terminal 62 is in circuit with a relay switch having its solenoid coil 71 associated with a normally closed switch 72 and a normally opened switch 73. The switches 69 and 73 are in circuit with the appropriate sides of the motor 34 so that when the switch 69 is closed, a circuit will be completed with a power source 70 so as to drive the motor 34 and the associated pump 33 in the trim up direction as previously described. In a like manner, when the switch 73 is closed, the motor 34 will be energized in a direction so as to drive the pump 33 in the trim down direction.

The hold up terminal 61 is in circuit with the base of a transistor 74 that has its emitter in circuit with a base of a transistor 75 that has its collector and emitter in circuit with the solenoid winding 67.

In a similar manner, the tilt hold down terminal 63 is in circuit with the base of a transistor 76. The transistor 76 is in circuit with a base of a transistor 77 for switching this transistor which is in circuit with the solenoid winding 71.

A limit arrangement is provided for switching off the holding circuits comprised of the transistors 74 and 75 and the transistor 76 and 77. This limit device is operative to ground the bases of the transistors 74 and 76 so as to turn them off when the tilt cylinder 22 reaches the extreme limits of its stroke. One way this may be done is by providing a tilt up pressure responsive switch 78 that is interposed in the tilt up pressure line 46. A similar tilt down pressure sensitive switch 79 is provided in the tilt down pressure line 38 between the pump 33 and shuttle valve 39. The switches 78 and 79 are adapted to close at a slightly lower pressure than the pressure at which the respective relief valves 47 and 52 open so that these switches will close before the respective relief valve opens. As may be seen in FIG. 3, the contacts of the switches 78 and 79 are interposed in a ground circuit of the gates of the transistors 74 and 76. Rather than employing pressure responsive valves, it may be possible to employ limit switches or the like for sensing when the tilt cylinder 22 is at the extreme limits of its stroke.

OPERATION

If it is desired to provide trim up operation, the operator operates the actuator 55 from the null position so as to bring the conductor 56 into contact with the terminal 59 and thus close the circuit between the power source 70 and the relay solenoid 67. The normally closed switch contact 68 will then open and the normally closed switch contact 69 will close so as to drive the motor 34 in a direction to pressurize the line 37 and have the line 38 (FIG. 2) act as a return line. When the operator releases the manual actuator 55 and it returns to the null position, the tilt and trim up operation will be discontinued.

Trim down operation is accomplished by the operator moving the actuator 55 from the null position so that the conductor 56 contacts the terminals 62 and energizes the relay winding 71 to actuate the switches 72 and 73 and drive the motor 34 in the opposite direction.

If the operator wishes to tilt the motor 11 up without continuing to hold the actuator 55 in its activated position, he moves it to bring the conductor 56 from the null position into contact with the terminal 61. This will cause the base of the transistor 74 to receive a voltage which causes it to become conductive and turns the base of the transistor 75 on. At this time, the relay winding 67 will be energized so as to open the normally closed contact 68 and close the normally opened contact 69 so as to energize the motor 34 in the trim up direction. The tilt cylinder 22 will then be continuously energized until the pressure in the tilt up line 78 indicates the end of the stroke and rises sufficiently so as to close the pressure responsive switch 78. This will ground the base of the transistor 74 and turn it off and, accordingly, turn off the transistor 75 so as to discontinue the operation of the motor 34 and pump 33.

If during this operation the operator wishes to deactivate the mechanism, he moves the actuator 55 so as to bring its terminal 57 into contact with the terminal 65. Since the terminal 57 is grounded, this causes the base of the transistor 74 to be grounded through the normally closed switch 72 and will turn it off as well as the transistor 75 so as to stop the energization of the relay solenoid 67.

It should be readily apparent that the continuous tilt down operation is achieved in the opposite manner by moving the conductor 56 into contact with the terminal 63 so as to switch the transistors 76 and 77 on and energize the relay solenoid 71. Tilt down operation may be discontinued by moving the member 55 so that the conductor 57 grounds the terminal 64 and, accordingly, the transistor 76.

It should be readily apparent that the described embodiment is highly effective in insuring that trim up or trim down operation may be accomplished without necessitating the operator's maintaining his hand on the manual switch during the full movement. Although an embodiment of the invention has been illustrated and described and other modifications suggested, yet other changes and modifications may be made without departing from the spirit and scope of the invention, as defined by the appended claims.

We claim:

1. A tilt mechanism for a marine outboard drive supported for tilting movement about a generally horizontally extending tilt axis relative to a watercraft, power means for selectively effecting tilting movement of said outboard drive about said tilt axis, and control means for selectively activating said power means, said control means including a control element movable between a null position and an activated position and a control device for selectively energizing said power means continuously upon the activation of said control element from its null position to its activated position without necessitating an operator to maintain said control element in its activated position, said control device further being selectively operable to actuate the power means only so long as the operator activates said control element to its activated position.

2. A tilt mechanism as set forth in claim 1 wherein the power means comprises a hydraulic motor and a hydraulic pump for driving the hydraulic motor.

3. A tilt mechanism as set forth in claim 2 wherein the hydraulic pump is driven by an electric motor and the control means controls the electric motor.

4. A tilt mechanism as set forth in claim 3 wherein the control device includes a holding circuit for maintaining the electric motor in an energized condition for the continuous operation of said hydraulic motor.

5. A tilt mechanism for a marine outboard drive as set forth in claim 4 wherein the control element's activated position comprises a first position wherein the control device energizes the power means continuously and a second position wherein the control device energizes the power means only so long as the operator activates the control element to this position.

6. A tilt mechanism as set forth in claim 4 wherein the hydraulic motor and pump are operative to tilt the outboard drive either up or down.

7. A tilt mechanism as set forth in claim 1 further including means for deactivating the control means when the power means reaches an end of its stroke.

8. A tilt mechanism for a marine outboard drive as set forth in claim 1 wherein the control element's activated position comprises a first position wherein the control device energizes the power means continuously and a second position wherein the control device energizes the power means only so long as the operator activates the control element to this position.

9. A tilt mechanism for a marine outboard drive supported for tilting movement about a generally horizontally extending tilt axis relative to a watercraft, power means for selectively effecting tilting movement of said outboard drive about said tilt axis, and control means for selectively activating said power means for energizing said power means continuously upon the activation of said control means without necessitating an operator to maintain said control means in its activated position, said control means further including means for discontinuing the operation of said power means when said power means reaches the limit of its travel.

* * * * *